US009229434B2

(12) United States Patent
Hasegawa

(10) Patent No.: US 9,229,434 B2
(45) Date of Patent: Jan. 5, 2016

(54) RADIO-CONTROLLED TIMEPIECE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/603,250

(22) Filed: Jan. 22, 2015

(65) Prior Publication Data

US 2015/0261194 A1 Sep. 17, 2015

(30) Foreign Application Priority Data

Mar. 13, 2014 (JP) ..... 2014-049889

(51) Int. Cl.
*G04R 20/02* (2013.01)

(52) U.S. Cl.
CPC ..... *G04R 20/02* (2013.01)

(58) Field of Classification Search
CPC ..... G04R 20/02; G04R 20/06; G04G 5/00; G01S 5/14
See application file for complete search history.

(56) References Cited

U.S. PATENT DOCUMENTS 8,264,914 B2 * 9/2012 Baba ..... G04G 5/002 368/47
8,792,308 B2 * 7/2014 Kato ..... G04R 20/06 368/47
2007/0205942 A1 * 9/2007 Xie ..... G01S 19/27 342/357.63

FOREIGN PATENT DOCUMENTS

JP 2001228271 A 8/2001
JP 2002090441 A 3/2002
JP 2011064486 A 3/2011

OTHER PUBLICATIONS

Japanese Office Action (and English translation thereof) dated Nov. 4, 2015, issued in counterpart Japanese Application No. 2014-049889.

* cited by examiner

*Primary Examiner* — Sean Kayes
(74) *Attorney, Agent, or Firm* — Holtz, Holtz, Goodman & Chick PC

(57) ABSTRACT

A radio-controlled timepiece is shown including the following. A receiving unit receives a transmitting radio wave including date/time information from a positioning satellite. A date/time information obtaining unit obtains a week number and elapsed time within a week as the date/time information. An operating unit receives operation. A term obtaining unit obtains a value of a 10 year digit of a present date and time. A first term setting unit sets a first date/time specified range including 10 years corresponding to the obtained value of the 10 year digit and a term adjacent to the 10 years with a predetermined length. A first date/time calculating unit calculates the present date and time within the set first date/time specified range. A date/time correcting unit corrects the date and time of a timekeeping unit based on the present date and time.

4 Claims, 6 Drawing Sheets

| TERM | WEEK NUMBER LAP |
|---|---|
| AUGUST 22, 1999 - APRIL 6, 2019 | 1 |
| APRIL 7, 2019 - NOVEMBER 20, 2038 | 2 |
| NOVEMBER 21, 2038 - JULY 6, 2058 | 3 |
| JULY 7, 2058 - FEBRUARY 19, 2078 | 4 |
| FEBRUARY 20, 2078 - OCTOBER 5, 2097 | 5 |
| OCTOBER 6, 2097 - MAY 22, 2117 | 6 |

FIG.3
| TERM | WEEK NUMBER LAP |
|---|---|
| AUGUST 22, 1999 – APRIL 6, 2019 | 1 |
| APRIL 7, 2019 – NOVEMBER 20, 2038 | 2 |
| NOVEMBER 21, 2038 – JULY 6, 2058 | 3 |
| JULY 7, 2058 – FEBRUARY 19, 2078 | 4 |
| FEBRUARY 20, 2078 – OCTOBER 5, 2097 | 5 |
| OCTOBER 6, 2097 – MAY 22, 2117 | 6 |
FIG.4A
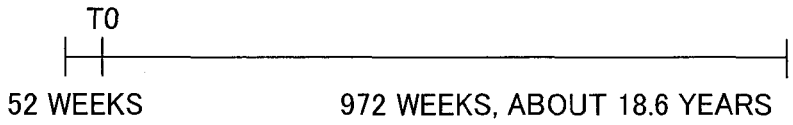
FIG.4B
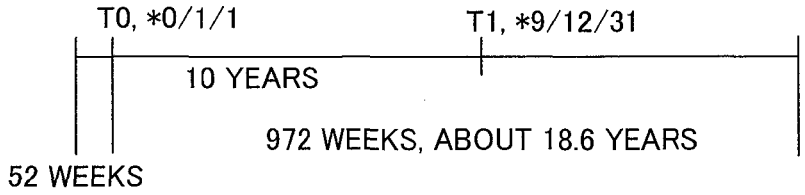

RADIO-CONTROLLED TIMEPIECE

BACKGROUND OF THE INVENTION

1. Field of the Invention

The present invention relates to a radio-controlled timepiece which receives a radio wave from a positioning satellite and corrects date and time.

2. Description of the Related Art

There has been an electronic timepiece (radio-controlled timepiece) which receives a radio wave from a satellite (positioning satellite) used in a positioning system of GNSS (Global Navigation Satellite System) to obtain date/time information. Such radio-controlled timepieces have a large reception area and are able to obtain date/time information within a short period of time compared to radio-controlled timepieces which are able to use other radio waves to obtain date/time information, such as a standard radio wave which transmits date/time information by a long wave band radio wave.

Conventionally, in order to obtain such date/time information, a positioning satellite (GPS satellite) of GPS (Global Positioning System) operated by the United States is widely used. Each of the GPS satellites include an atomic timepiece. According to the value calculated by the atomic timepiece, information showing week number from Jan. 6, 1980 (which is the starting timing of the calculating) and elapsed time within the week is calculated and transmitted. Therefore, the radio-controlled timepiece converts the received week number and elapsed time within the week to obtain the present date and time.

The week number is a 10 bit value, and one lap is 1024 weeks, in other words about 19.6 years. Therefore, at present, the week number is in the second lap. Typically, the radio-controlled timepiece calculates the date and time individually, and as long as the calculation is normally performed, a difference of nearly 20 years does not occur by the error (for example, about 0.5 seconds per day) of the oscillating circuit usually used in such radio-controlled timepieces. Therefore, it is possible to judge which lap the week number belongs to based on the calculated value. However, when the battery of the radio-controlled timepiece is consumed and the operation cannot be maintained, or the battery is temporarily detached for replacement, even if the radio-controlled timepiece is restarted after replacing the battery, the entire operation and storage is reset. This means there is no date/time information to refer to. Therefore, if the radio wave is received from the GPS satellite in such state, there is a problem that the radio-controlled timepiece is not able to determine the lap of the week number. Moreover, it is rare that the user of the radio-controlled timepiece knows the term of each lap of the week number. Therefore, the user needs to perform the troublesome task of searching the term to directly set the radio-controlled timepiece.

In view of the above, Japanese Patent Application Laid-Open Publication No. 2011-64486 (corresponding to U.S. Pat. No. 8,264,914B2) describes the following technique. A specific value showing a part of a date such as "day" input manually and a candidate of the specific value calculated from the obtained week number and the elapsed time within the week are compared, and the date within a predetermined range from a predetermined reference date is identified. Moreover, Japanese Patent Application Laid-Open Publication No. 2002-90441 describes the following technique. The date/time information is obtained from outside by other methods such as a standard radio wave to identify the lap to which the week number of the GPS satellite belongs.

However, according to conventional methods, other radio waves cannot always be received, or the lap of the week number cannot be specified outside the first set term. Moreover, even within the set term, it is necessary to refer to the table data and determine the result, and this leads to increase of the configuration and the processing becoming troublesome.

SUMMARY OF THE INVENTION

The present invention has been conceived in view of the above problems, and one of the main objects is to provide a radio-controlled timepiece which is able to identify a lap of a week number flexibly throughout a long period of time with easy operation and processing to obtain accurate date and time.

According to an aspect of the present invention, there is provided a radio-controlled timepiece including:

a receiving unit which receives a transmitting radio wave including date/time information from a positioning satellite;

a date/time information obtaining unit which obtains a week number and elapsed time within a week as the date/time information from the received transmitting radio wave;

an operating unit which receives operation from a user;

a term obtaining unit which obtains a value of a 10 year digit of a present date and time according to input operation through the operating unit;

a first term setting unit which sets a first date/time specified range including 10 years corresponding to the obtained value of the 10 year digit and a term adjacent to the 10 years with a predetermined length, the first date/time specified range set to a length equal to or shorter than one lap of the week number;

a first date/time calculating unit which calculates the present date and time within the set first date/time specified range according to the week number and the elapsed time within the week;

a timekeeping unit which counts date and time; and a date/time correcting unit which corrects the date and time of the timekeeping unit based on the present date and time calculated by the first date/time calculating unit.

BRIEF DESCRIPTION OF THE DRAWINGS

The present invention and the above-described objects, features and advantages thereof will become more fully understood from the following detailed description with the accompanying drawings and wherein;

FIG. 3 is a table showing a term of each lap of a week number;

FIG. 4A and FIG. 4B are diagrams describing an example of a range of a set term;

DESCRIPTION OF THE PREFERRED EMBODIMENTS

An embodiment of the present invention is described with reference to the drawings.

Figure 1:
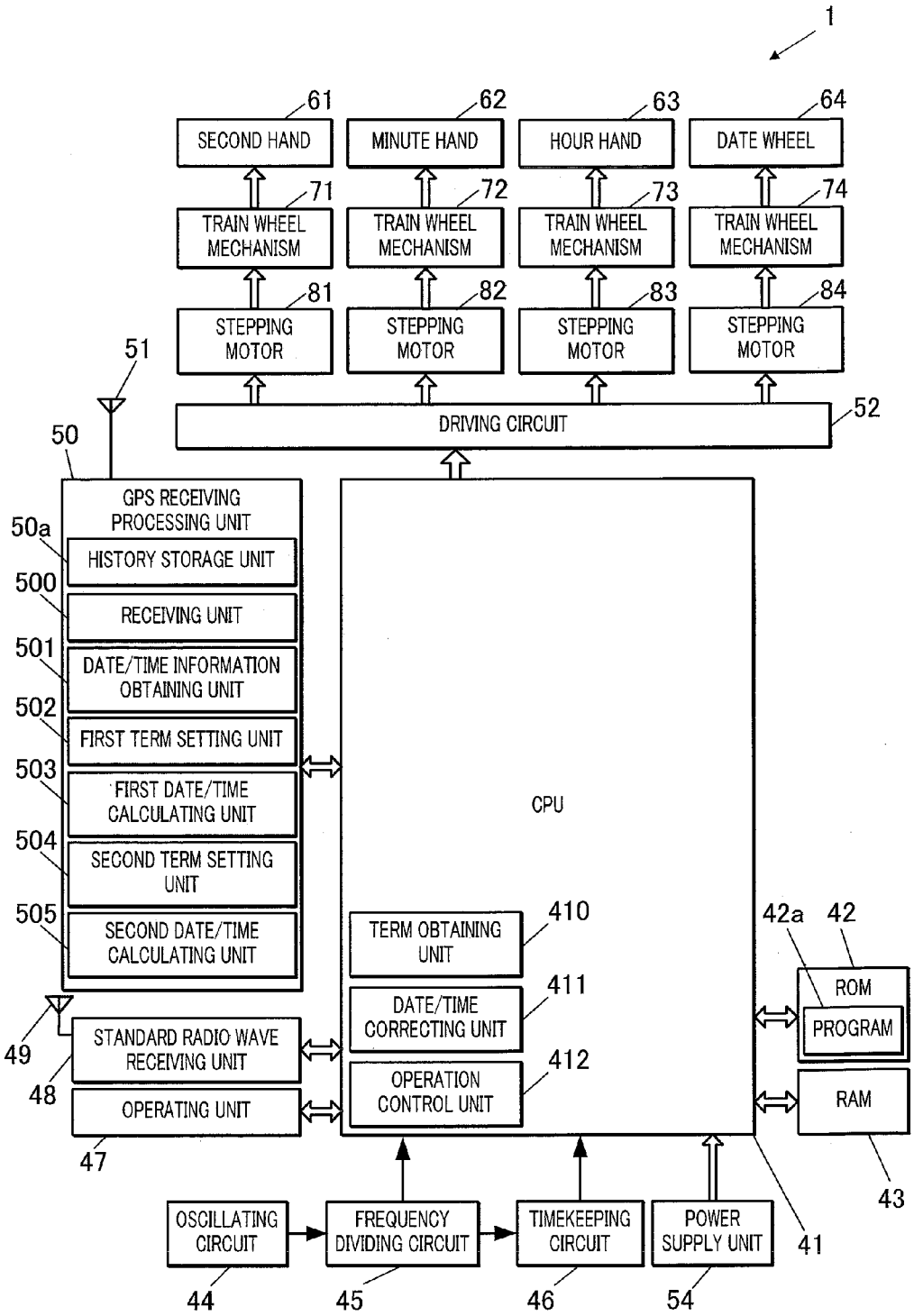
FIG. 1 is a block diagram showing an internal configuration of a radio-controlled timepiece of an embodiment of the present invention.

FIG. 1 is a block diagram showing an internal configuration of a radio-controlled timepiece 1 which is an embodiment of a radio-controlled timepiece of the present invention.

The radio-controlled timepiece 1 includes a CPU (Central Processing Unit) 41 (term obtaining unit 410, date/time correcting unit 411, operation control unit 412), a ROM (Read Only Memory) 42, a RAM (Random Access Memory) 43, an oscillating circuit 44, a frequency dividing unit 45, a timekeeping circuit 46 (timekeeping unit), an operating unit 47, a standard radio wave receiving unit 48 and antenna 49, a GPS receiving processing unit 50 (receiving unit 500, date/time information obtaining unit 501, first term setting unit 502, first date/time calculating unit 503, second term setting unit 504, second date/time calculating unit 505) and antenna 51, a driving circuit 52, a power supply unit 54, a second hand 61 and a train wheel mechanism 71 to rotate the second hand 61, a minute hand 62 and a train wheel mechanism 72 to rotate the minute hand 62, an hour hand 63 and a train wheel mechanism 73 to rotate the hour hand 63, a date wheel 64 and a train wheel mechanism 74 to rotate the date wheel 64, and stepping motors 81 to 84 each of which operate the train wheel mechanisms 71 to 74 respectively.

The CPU 41 performs various calculating processing and centrally controls the entire operation of the radio-controlled timepiece 1. The CPU 41 controls the hand operation regarding the display of the date and time, operates the standard radio wave receiving unit 48 to obtain receiving data to calculate the date and time, and operates the GPS receiving processing unit 50 to obtain the date/time information. The CPU 41 corrects the date and time kept by the timekeeping circuit 46 based on the obtained date/time data.

The ROM 42 stores a program 42*a* for various control performed by the CPU 41 and setting data. The program 42*a* includes, for example, a program to correct the date and time kept by the timekeeping circuit 46.

The RAM 43 provides a memory space for a job in the CPU 41 and stores temporary data. The RAM 43 stores data showing history of correction of the date and time and the hand position.

The oscillating circuit 44 generates a predetermined frequency signal and outputs the signal. For example, the oscillating circuit 44 includes a crystal oscillator.

The frequency dividing circuit 45 divides the frequency signal output from the oscillating circuit 44 to a signal of a frequency used in the CPU 41 or the timekeeping circuit 46 and outputs the signal. The output frequency can be set to be changeable with the control signal from the CPU 41.

The timekeeping circuit 46 calculates and adds the frequency dividing signal input from the frequency dividing circuit 45 to the initial value showing a predetermined date and time to calculate the present date and time. The date and time calculated by the timekeeping circuit 46 includes an error according to the accuracy of the oscillating circuit 44, for example, about 0.5 seconds per day. In other words, although a difference of about 3 minutes occur each year if the date and time calculated by the timekeeping circuit 46 is not corrected, a difference in the unit of hours and days is usually not assumed. The date and time calculated by the timekeeping circuit 46 can be corrected by the control signal from the CPU 41.

The operating unit 47 receives input from the user. The operating unit 47 includes a press button switch or a winding crown. When the press button switches are operated, or the winding crown is pulled out and rotated, the electric signal according to the type of operation is output to the CPU 41.

The standard radio wave receiving unit 48 receives the radio wave in a long wavelength band using an antenna 49, demodulates the time signal output (TCO) of the standard radio wave with the amplitude modulated, and outputs the signal to the CPU 41. The frequency of the long wavelength band tuned by the standard radio wave receiving unit 48 is adjusted by control from the CPU 41 according to the transmitting frequency from the standard radio wave transmitting station of the receiving target. Moreover, the standard radio wave receiving unit 48 performs various processing to enhance the receiving sensitivity, digitizes the analog signal at a predetermined sampling frequency and outputs the signal to the CPU 41.

The GPS receiving processing unit 50 receives a radio wave in the Li band using the antenna 51 (1.57542 GHz in the GPS satellite), and demodulates and decodes a transmitting radio wave with spectral diffusion from the positioning satellite, here the GPS satellite, to decipher the signal (navigation message data). The deciphered signal is output to the CPU 41 in a predetermined format. The operation control regarding the receiving, deciphering, and output is performed by the control unit (microcomputer) provided in the GPS receiving processing unit 50. The configuration which performs various operation such as demodulating, decoding, deciphering, and control in the GPS receiving processing unit 50 is formed on a single chip as a collective module, and is connected to the CPU 41. The control of on and off of the operation of the GPS receiving processing unit 50 is performed independent from the operation of the other units of the electronic timepiece 1 by the CPU 41. When the operation of the GPS receiving processing unit 50 is off, the supply of electric power to the GPS receiving processing unit 50 is also paused to save electric power.

The GPS receiving processing unit 50 includes a storage unit. In the storage unit, a nonvolatile memory such as a flash memory or EEPROM (Electrically Erasable and Programmable Read Only Memory) is used so that the stored content is held regardless of the state of supply of electric power to the GPS receiving processing unit 50. The storage unit includes a history storage unit 50*a* (nonvolatile storage unit) which stores the latest history of operation. Various operation control programs, predicted orbit information of each GPS satellite, setting value when the date/time data is obtained, and the like can be stored in the storage unit. The predicted orbit information is stored in the RAM 43 of the electronic timepiece 1, and the control unit can receive the information from the CPU 41 as necessary. The operation control program can be stored in a dedicated ROM, and the program can be read when the apparatus is started and loaded in the RAM of the control unit.

The power supply unit 54 supplies the electric power for the operation of each unit at a predetermined voltage. The power supply unit 54 includes a battery, and as the battery, for example, a solar battery and a secondary battery are provided. Alternatively, a replaceable button type dry battery can be used as the battery.

The second hand 61, the minute hand 62, the hour hand 63, and the date wheel 64 (here, any or all of the above may be simply referred to as hand) are each a hand which show the second, the minute, the hour, and the date, respectively. Here, the second hand 61, the minute hand 62, and the hour hand 63 are needle shaped hands with the substantial center of a dial face 3 (see FIG. 7A) provided on the surface of the electronic timepiece 1 being the rotating axis. The time, various types of functions, and states are shown by the position of the dial provided on the dial face 3 or the pointed index. The date wheel 64 is provided with indexes at an equal interval showing the date on a circumference of a round plate, and one index is exposed from an opening 4 provided in the dial face 3 to show the date.

The wheel mechanisms 71 to 74 are each a combination of a plurality of gears which rotate the second hand 61, the minute hand 62, the hour hand 63, and the date wheel 64 a predetermined angle at a time according to the rotation operation of the stepping motors 81 to 84. For example, the stepping motor 81 is driven once every second to rotate the second hand 61 six times on the dial face 3 with the wheel mechanism 71 and this shows 1 second passed. The stepping motor 82 is driven once every 10 seconds to rotate the minute hand 62 once on the dial face 3 with the wheel mechanism 72 and this shows 10 seconds passed.

Here, each of the stepping motors 81 to 84 individually rotate the wheel mechanism 71 to 74. However, a gear of some of the wheel mechanisms can rotate together with a common stepping motor.

The driving circuit 52 outputs a driving pulse with a predetermined voltage to the stepping motors 81 to 84 according to a control signal from the CPU 41. The driving circuit 52 is able to change the length (pulse width) of the driving pulse according to the state of the electronic timepiece 1. Moreover, when a control signal to drive a plurality of the hands at the same time is input, the output timing of the driving pulse can be slightly shifted to reduce the burden.

Next, the format of the transmitting signal from the GPS satellite received by the GPS receiving processing unit 50 is described.

Figure 2:
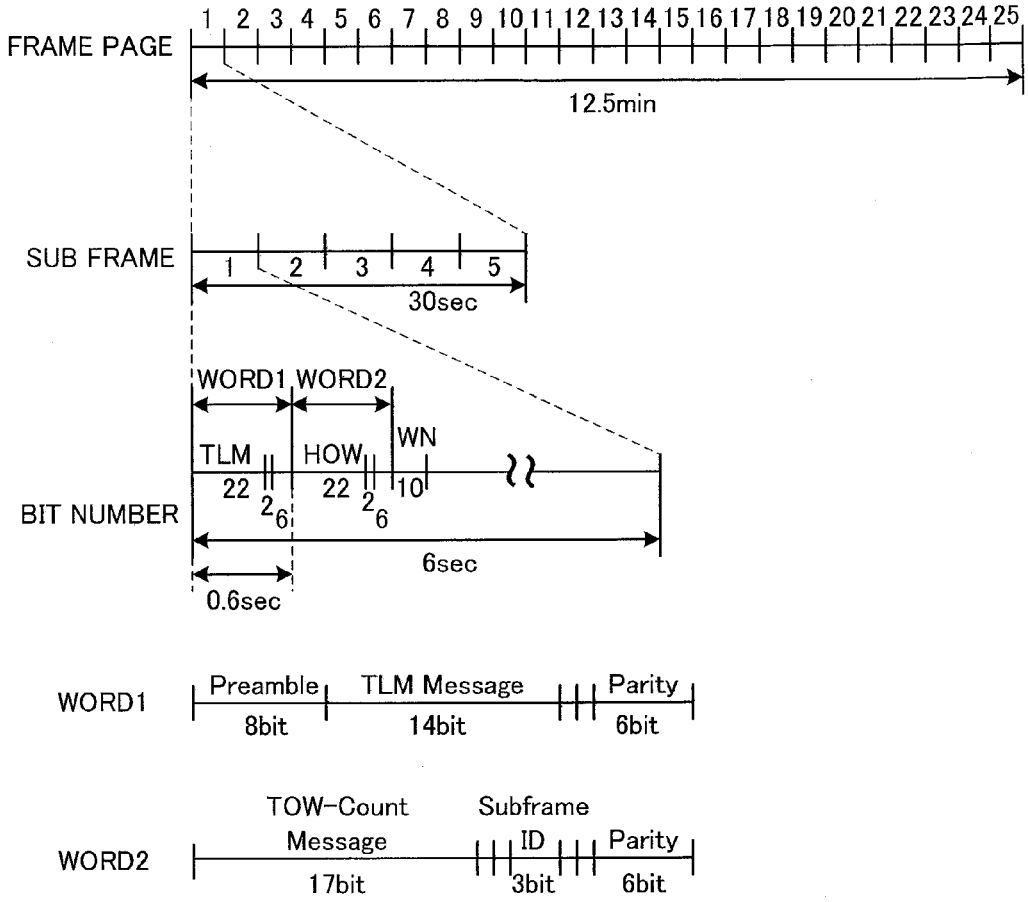
FIG. 2 is a diagram describing a format of a transmitting signal from a GPS satellite.

FIG. 2 is a diagram which describes a format of the transmitting signal from the GPS satellite.

The navigation message transmitted from the GPS satellite includes 25 frames in a unit of 30 seconds. Each frame includes 5 sub-frames in the unit of 6 seconds. Further, each sub-frame includes 10 WORD in a unit of 0.6 seconds.

Each WORD includes 30 bits. Among the above, the format of the WORD1 and WORD2, which are the 2 WORD from the front of the sub-frame, is common in all sub-frames. The first 22 bits of the WORD1 show TLM (telemetry word) and further the first 8 bits are a Preamble fixed each time. The first 22 bits of WORD2 show HOW (hand over word), and further the first 17 bits are TOW-count (Time of Week) showing the date and time (elapsed time within the week) after the day of the week.

Each word after WORD3 shows a different content in each sub-frame. In the first sub-frame (sub-frame 1), the first 10 bits of WORD3 show the week number WN.

In other words, the date and time is obtained from the combination of the week number WN and the elapsed time within the week TOW-count obtained from the receiving data of the sub-frame 1.

However, the week number WN is shown with 10 bits, and therefore, only up to 1024 weeks (about 19.6 years) can be shown. Therefore, in order to obtain the accurate date and time based on the receiving data from the GPS satellite, separate information showing which lap the week number WN belongs to is necessary.

FIG. 3 is a table showing the term belonging to each lap of the week number WN.

Regarding the week number WN, the first lap started on Jan. 6, 1980, and at present, the week number WN is in the second lap. The second lap (here, week number lap 1) started on Aug. 22, 1999, and continues until Apr. 6, 2019. Similarly, the third lap (week number lap 2) is from Apr. 7, 2019 to Nov. 20, 2038, and the fourth lap (week number lap 3) is from Nov. 21, 2038 to Jul. 6, 2058. In this way, the lap of the week number WN is repeated about every 19.6 years.

Usually, the electronic timepiece 1 counts the date and time with the timekeeping circuit 46. As described above, even if the correction is not performed at all, it is assumed that the date and time does not differ in the amount of one day or more. Therefore, by referring to the date and time of the timekeeping circuit 46, it is easily specified which lap the week number WN belongs to. However, when the operation of the electronic timepiece 1 stops due to the battery running out, and all of the temporary data stored in the RAM 43 and the timekeeping circuit 46 is cleared (BAC), the date and time of the timekeeping circuit 46 returns to the initial value. Therefore, it is not possible to specify the lap of the week number WN even if the date/time information is newly obtained from the GPS satellite.

In the electronic timepiece 1 of the present embodiment, the lap itself of the week number is not specified, but the term including the latest date and time when the date and time was obtained stored in the history storage unit 50*a* of the GPS receiving processing unit 50 or the 10 years input from the operating unit 47 by the user is dynamically set. With this, the date and time in the respective term is specified from the deciphered week number and the elapsed time within the week.

FIG. 4A and FIG. 4B are diagrams describing an example of a set range of a term.

When a date is obtained from the history storage unit 50*a*, as shown in FIG. 4A, in the electronic timepiece 1, a term of 1024 weeks from 52 weeks before the date (TO) to 972 weeks after the date is set as the term in which the date is specified (second date/time specified range). According to such setting, the date which belongs to the obtained week number is uniquely specified.

However, according to such setting, when 972 weeks have passed from the obtained date or when the radio wave has never been received from the GPS satellite, the correct date and time cannot be obtained. As shown in FIG. 4B, further, in the electronic timepiece 1, a term of 1024 weeks from 52 weeks before the first date of the 10 years (TO) input by the user to 972 weeks after the above date can be set as the term in which the date is specified (first date/time specified range). Since the entire term of the 10 years (from T0 to T1) input is always included in the 1024 weeks, regardless of the position of the actual date and time in the 10 year term, the date belonging to the obtained week number is uniquely specified.

Therefore, according to the electronic timepiece 1 of the present embodiment, the lap of the week number is increased or decreased so that the date and time calculated from the week number WN and elapsed time within the week TOW-count is within the set term including the 10 years suitably input when necessary. Consequently, it is not necessary to consider the timing that the week number switches or the timing of the initial setting when the product is examined.

Next, the returning operation after BAC in the electronic timepiece 1 of the present embodiment is described.

In the electronic timepiece 1 of the present embodiment, when restarting and resetting after BAC, the radio wave is received from the GPS satellite and the date and time is set again.

Figure 5:
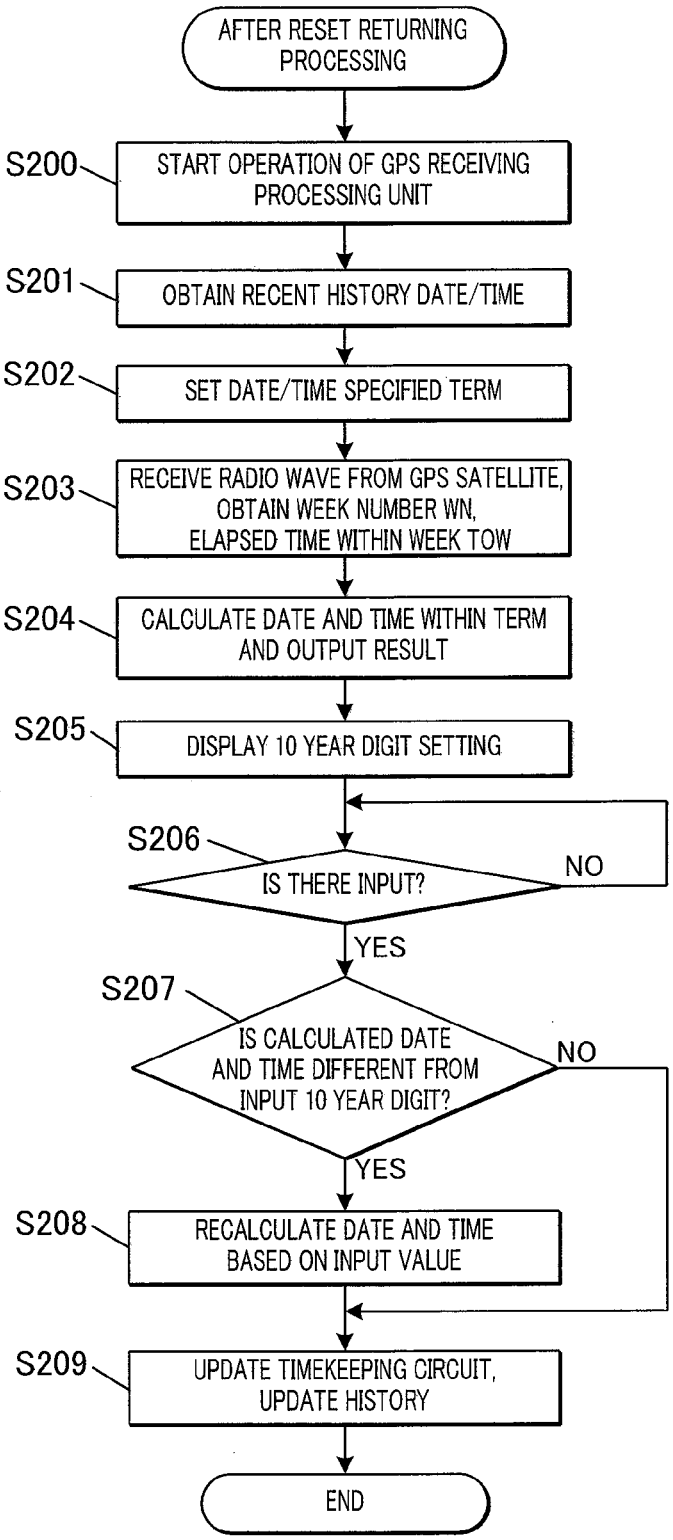
FIG. 5 is a flowchart showing control process by a CPU and a control unit of a GPS receiving processing unit in after reset returning processing performed by the radio-controlled timepiece.

FIG. 5 is a flowchart showing the control process by the CPU 41 and the GPS receiving processing unit 50 in the after reset returning processing performed in the electronic timepiece 1.

When the after reset returning processing starts, the CPU 41 operates the GPS receiving processing unit 50 and obtains the date and time (step S200). The control unit of the GPS receiving processing unit 50 obtains the latest reception history from the history storage unit 50*a* and obtains the latest history date/time (or only date) (step S201). The control unit calculates the week number and the week number lap that includes the date of the above date and time, and the term from 52 weeks before to 972 weeks after is set as the date/time specified term (second date/time specified range) (step S202).

The control unit starts receiving the radio wave from the GPS satellite using the antenna 51 and obtains the week number WN and the elapsed time within the week TOW-Count (step S203). Among the date and time obtained from the week number WN and the elapsed time within the week TOW-Count, the control unit identifies the date and time within the date/time specified term specified in step S202 as the present date and time and outputs the identified date and time to the CPU 41 (step S204).

When the date and time is obtained from the GPS receiving processing unit 50, the CPU 41 outputs a control signal to the driving circuit 52 and switches the hands 61 to 63 to the display state regarding reception of input of the 10 year digit (step S205). Then, the CPU 41 judges whether there is input (step S206), and while it is judged that there is no input ("NO" in step S206), the CPU 41 repeats the processing of step S206 and waits for input. When it is judged that there is input ("YES" in step S206), the CPU 41 judges whether the value of the input (obtained) 10 year digit is different from the value of the 10 year digit of the date and time obtained from the GPS receiving processing unit 50 (step S207). When it is judged that the above is not different (the same) ("NO" in step S207), the processing of the CPU 41 advances to step S209.

When it is judged that the above is different (not the same) ("YES" in step S207), the CPU 41 sets the date/time set term including the 10 years (first date/time specified range), and recalculates the date and time corresponding to the obtained date and time (week number WN and elapsed time within the week TOW-Count) or outputs the setting to the GPS receiving processing unit 50 and receives the radio wave again (step S208). Then, the processing of CPU 41 advances to step S209.

When the processing advances to step S209, the CPU 41 corrects the date and time calculated by the timekeeping circuit 46 based on the obtained date and time, and also updates the latest reception history stored in the history storage unit 50*a* (step S209). Then, the CPU 41 and the control unit of the GPS receiving processing unit 50 ends the after reset returning processing.

Figure 6:
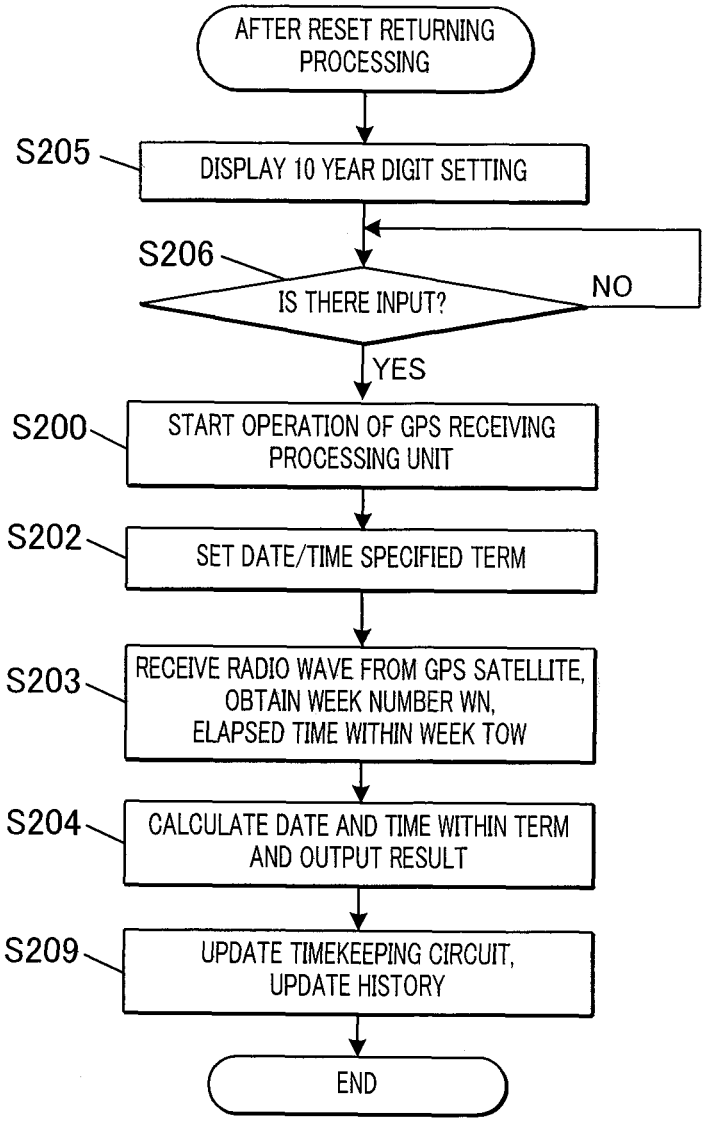
FIG. 6 is a flowchart showing control process by the CPU and the control unit of the GPS receiving processing unit of examples other than the after reset returning processing.

FIG. 6 is a flowchart showing control process by the CPU 41 and the GPS receiving processing unit 50 regarding another example of the after reset returning processing.

Other examples of after reset returning processing is performed when the user actively resets the timepiece, for example, in the initial setting at the factory or resetting after repair.

In this example, the processing of steps S201, S207, S208 in the above embodiment are omitted, and the processing of steps S205 and S206 are performed before the processing of steps S200 and S202 to S204.

In other words, in this example, when the after reset returning processing is started, first, the CPU 41 outputs the control signal to the driving circuit 52 and advances to the display state regarding reception of input of the 10 year digit (step S205) and judges whether there is input (step S206). While it is judged that there is no input ("NO" in step S206), the processing of step S206 is repeated and the CPU 41 waits for input. When it is judged that there is input ("YES" in step S206), the CPU 41 starts the operation of the GPS receiving processing unit 50 (step S200), and outputs the input 10 year digit to the GPS receiving processing unit 50. The control unit of the GPS receiving processing unit 50 sets the date/time specified term from the input 10 year digit (step S202).

The CPU 41 controls the GPS receiving processing unit 50 to perform the radio wave receiving operation from the GPS satellite and obtains the week number WN and the elapsed time within the week TOW-Count (step S203). The control unit of the GPS receiving processing unit 50 identifies the date and time in the set date/time specified term based on the above week number WN and the elapsed time within the week TOW-Count, and outputs the identified date and time to the CPU 41 (step S204). The CPU 41 updates the date and time calculated by the timekeeping circuit 46 based on the date and time obtained from the GPS receiving processing unit 50, and the GPS receiving processing unit 50 updates the history with the above date and time as the recent history of reception (step S209). Then, the CPU 41 ends the after reset returning processing.

As described above, according to the after reset returning processing of the above example, the user inputs the 10 year digit first, and therefore, the GPS receiving processing unit 50 is able to immediately specify the present date and time.

Figure 7A:
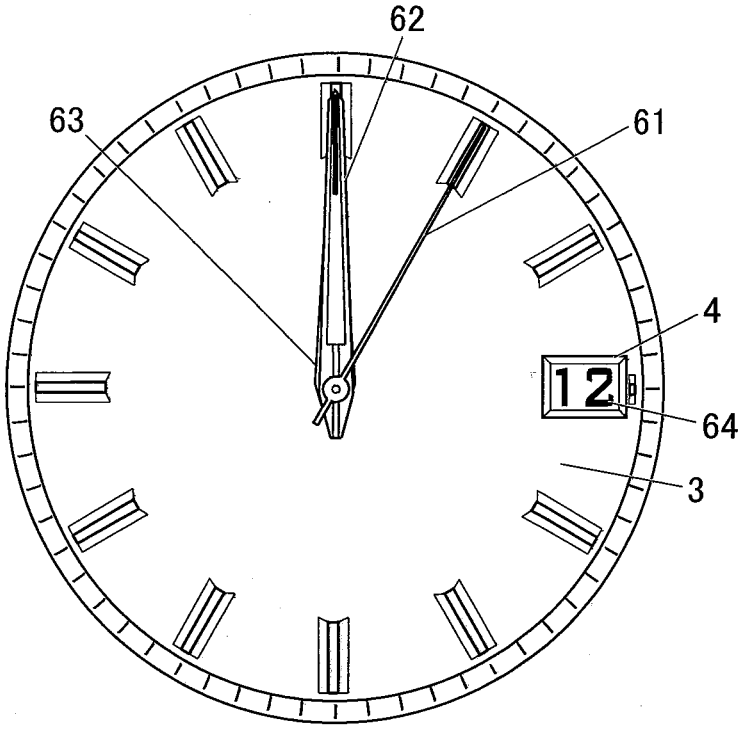
FIG. 7A and FIG. 7B are front views showing an example of a 10 year digit input screen in the radio-controlled timepiece of the present embodiment.
Figure 7B:
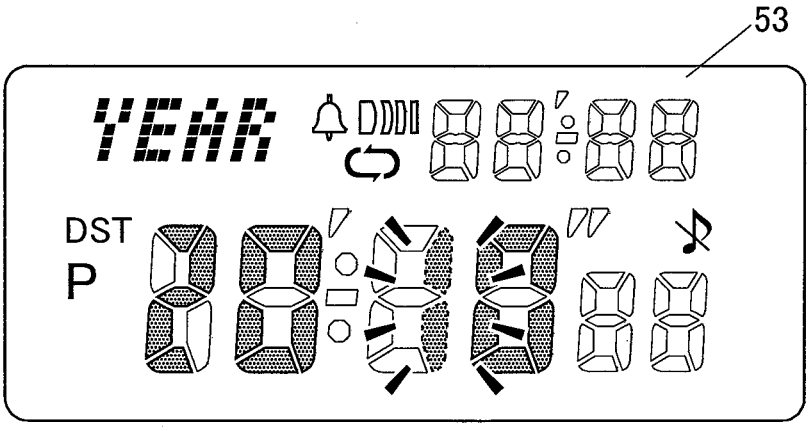

FIG. 7A and FIG. 7B are front views showing an example of a 10 year digit input screen in the electronic timepiece 1 of the present embodiment.

As shown in FIG. 7A, when the user inputs the 10 year digit in the electronic timepiece 1, the second hand 61, the minute hand 62, and the hour hand 63 which have a rotating axis rotating around the substantial center of the dial face 3 are set so that the hour hand 63 and the minute hand 62 are set to the position of 0 hours and 0 minutes and the second hand 61 is set to the position of 5 seconds (1 o'clock). With this, the electronic timepiece 1 is in the state to receive the 10 year digit. The value of the 10 year digit is input by moving the second hand 61 in the direction of each hour, and the 10 year digit is set to the value of the corresponding "hour". Here, since the second hand 61 points in the direction of 1 o'clock, it is shown that it is in the term of 2010's. The operation of the second hand 61 is performed by for example, the user pulling out the winding crown 1 step and rotating the winding crown 1 step. Here, the configuration can be made so that when the rotation of the winding crown rotated 1 step is detected, the CPU 41 moves the second hand 61 successively 5 steps so that the second hand 61 only points a position of a certain hour. When the second hand 61 is not moved every 5 steps, the CPU 41 can judge that the 10 year digit corresponding to the position where the second hand 61 is closest to the hour is the input. Then, when the winding crown is pushed back, the value of the input of the 10 year digit is fixed, and the CPU 41 obtains the input value.

When the date wheel 64 is moved to the date of the initial setting, time and electric power is necessary for detecting the position where the date wheel 64 stops and the later operation. Therefore, at this point, the CPU 41 can stop the date wheel 64 in the last position before BAC.

Here, when the history storage unit 50*a* of the GPS receiving processing unit holds the history date/time, or the radio wave is received from the GPS satellite based on the history date/time and the present date and time is calculated, the value of the 10 year digit corresponding to the history date/time or the present date and time can be displayed with the second hand 61 as the initial value.

An indicator of the date/time correction mode or the 10 year digit input mode can be provided on the dial face 3, and the setting can be shown by any of the second hand 61, the minute hand 62, and the hour hand 63. In order to actively notify the user that the mode is the above mode, the hand can move intermittently or continuously back and forth to the front and back of the indicator position.

When a digital display screen is provided in addition to or instead of the analog display function using the hand in the electronic timepiece 1, it is possible to show that the state is the 10 year digit input state more easily. As shown in FIG. 7B, for example, the digital display screen 53 is a liquid crystal display provided with a display region in a segment method and a display region in a dot matrix method. The digital display screen 53 is driven by the display driver (not shown) and the content is controlled through a control signal from the CPU 41. Here, "YEAR" is displayed in the display region of the dot matrix method in the upper left showing that the state is the year display state. "2010" is displayed in the display region of the segment method in the lower center with "1" in the 10 year digit flashing, showing the state that the change of the 10 year digit can be received.

As described above, the electronic timepiece 1 of the present embodiment includes the GPS receiving processing unit 50 which receives the transmitting radio wave including date/time information from the GPS satellite and obtains the week number and the elapsed time within the week as the date/time information from the received transmitting radio wave, the operating unit 47 which receives operation performed by the user, the timekeeping circuit 46 which counts the date and time, and the CPU 41. The GPS receiving processing unit 50 responds to the input operation through the operating unit 47, and obtains the value of the 10 year digit of the present date and time, sets the term of 52 weeks before the first day of the 10 years corresponding to the value of the obtained 10 year digit and 972 weeks including the 10 years as the date/time specified term (first date/time specified range), and calculates the present date and time in the date/time specified term according to the week number and the elapsed time within the week. Then, the CPU 41 corrects the date and time of the timekeeping circuit 46 based on the present date and time calculated in the GPS receiving processing unit 50.

Therefore, by easy operation and processing on the electronic timepiece 1, it is possible to identify the lap of the week number flexibly throughout a long period of time about the same length as a length of time that the accurate year information can be obtained by receiving the standard radio wave (last 2 digits of the year) and the accurate date and time can be obtained. Specifically, the date/time specified term is flexibly set variably and the accurate date and time can be obtained easily for a long period of time after shipment from the factory regardless of initial setting in manufacturing and testing and timing of switching of the week number lap.

Specifically, when BAC occurs and the storage information of the RAM 43 and the timekeeping circuit 46 of the electronic timepiece 1 is completely erased, the date/time display can be returned to normal easily, reliably, and speedily. The erased information includes information regarding the time zone, and therefore, even if the electronic timepiece 1 is able to receive the standard radio wave, the transmitting station from where the target standard radio wave is received returns to the predetermined initial setting. Therefore, when the timepiece is in other time zones, since a very long period of time is necessary to receive the standard radio wave and to obtain the date/time information, the accurate date/time information can be obtained in a short period of time effectively compared to situations as described above.

Especially in a returning operation after testing or repair in the factory, compared to receiving the standard radio wave or manually setting other items or all items regarding the date and time, the trouble and the necessary amount of time can be drastically decreased and the efficiency of work increases.

Moreover when the user uses the timepiece, the setting items after BAC is simplified and made easy. Therefore, the user does not become confused about how to set the timepiece and does not have to thoroughly read the manual.

Moreover, the timepiece includes the second hand 61, the minute hand 62, the hour hand 63, and the date wheel 64 which are rotatably provided to be able to move independently, and the CPU 41 controls the display by the above hands through the driving circuit. When the second hand 61 points any direction on the hour from 1 o'clock to 10 o'clock, the CPU 41 obtains the value of 1 to 9 or 0 corresponding to the pointed hour as the value of the 10 year digit.

Therefore, in the analog electronic timepiece in which complicated display of information other than the time is difficult, it is possible to identify which week number lap the date and time belongs to reliably regardless of the switching timing of the week number lap by a simple operation of simply setting 1 number of 1 digit.

The history storage unit 50*a* using the nonvolatile memory is provided in the GPS receiving processing unit 50 of the electronic timepiece 1, and when the date and time of the latest occasion of obtaining the date/time information from the GPS is stored in the history storage unit 50*a*, the GPS receiving processing unit 50 sets a term from 52 weeks before and 972 weeks after the latest date as the date/time specified term (second date/time specified range). The present date and time within the set date/time specified term is calculated according to the week number and the elapsed time within the week obtained by receiving the transmitting radio wave from the GPS satellite. When the latest date and time is not stored in the history storage unit 50*a* or the date and time within the date/time specified term (second date/time specified range) is calculated, the CPU 41 obtains the value of the 10 year digit from the operating unit 47. The GPS receiving processing unit 50 judges whether the present date and time calculated within the second date/time specified range is within the date/time specified term (first date/time specified range) set according to the value of the 10 year digit obtained by the operating unit 47. When it is judged that the date and time is not within the first date/time specified range, the present date and time is calculated again based on the first date/time specified range. Therefore, with the exception of when the date/time information is not received from the GPS satellite for a long period of time or is never received, the accurate date and time can be obtained based on the history information which is not erased even by BAC. Therefore, the trouble of the user can be further decreased. Moreover, in such case also, it may not be possible to obtain the present date and time accurately from the reception history of the date/time information from the GPS satellite. Therefore, the present date and time can be obtained easily and reliably by confirmation and simple correction operation by the user.

The 10 year digit obtained by provisionally calculating the date and time can be used as the initial value for the display of the setting screen. Therefore, there is a high possibility that the value can be corrected from a value of the 10 year digit closer than the setting from the initial value.

The present invention is not limited to the above described embodiments and suitable modifications are possible.

For example, according to the above embodiment, a term of 1024 weeks is set starting from 52 weeks before a specific date as the date/time specified term. However, the term set before the specific date and the term set 10 years later than the specific date (adjacent term) is not limited to the above example. The present date and time being before a specific date is usually not assumed unless due to influence of the time zone. Therefore, the term can start from, for example, 1 day before the specific date. Moreover, instead of in the unit of days, the date/time specified term can be set in the unit of weeks with the start of the week including the specific date being the reference.

Normally, it is not assumed that the 10 year digit specified by the user is different from the actual value. Therefore, if the 10 years of the above 10 year digit are included, instead of setting all of the 1024 weeks as the date/time specified term, for example, the date one day before the first date of the 10 years to one day after the last date can be set as the term. However, by setting the term to 1024 weeks, it is possible to perform the operation with the same processing as using the history data of the history storage unit 50*a*.

The above described embodiment describes the analog electronic timepiece 1 provided with the second hand 61, the minute hand 62, the hour hand 63, and the date wheel 64, and the electronic timepiece 1 provided with the digital display screen 53. The number and position of the hands and the size and the display format of the digital display screen is not limited to the above. For example, when the hand for the function mode display is separately provided, it is possible to more easily show that the timepiece is in the state of receiving input of the 10 year digit with the hand. For example, an organic EL display can be used as the digital display screen.

According to the above embodiment, only the 10 year digit is input. Alternatively, for example, the direction of 10 o'clock and 11 o'clock on the hour can be respectively corresponded with 2100's or 2110's, and the input can be partially corresponded to the 100 year digit. It is possible to determine at which value of the 10 year digit the switch is made between the 2000's and the 2100's based on the latest history date/time in the history storage unit 50*a* in addition to the setting when shipped from the factory.

According to the present embodiment, the setting of the date/time specified term is performed in the GPS receiving processing unit. However, the setting can be performed in the CPU 41 and output to the GPS receiving processing unit.

According to the present embodiment, it is judged whether the 10 year digit of the present date and time calculated based on the history date/time of the latest reception by the CPU 41 in the after reset returning processing is the same as the input 10 year digit. However, the range is not limited to the 10 year digit range, and can be the range of the date/time specified term set based on the 10 year digit. Such determining processing can be performed in the GPS receiving processing unit 50.

According to the present embodiment, the processing always advances to the state of receiving input of the 10 year digit after the radio wave is received from the GPS satellite. However, the processing can advance to the setting state by operation by the user through the operating unit 47. In this case, the processing from step S205 and after in the after reset returning processing shown in FIG. 5 can be performed separately.

According to the present embodiment, in the after reset returning processing, first, the radio wave is received from the GPS satellite. However, an attempt can be made to receive the standard radio wave first, and when the reception fails, the processing can advance to receiving the radio wave from the GPS satellite.

Moreover, when the radio wave is received from the GPS satellite, in addition to obtaining the date, the positioning can be performed. The setting of the time zone returned to the initial setting (city setting) can be performed based on the positioning result.

According to the present embodiment, the radio wave is received from the GPS satellite. The present invention can also be applied when the date/time information after BAC is obtained by receiving the radio wave from a positioning satellite using the navigation data format the same as or conforming to the format of the GPS satellite.

The specific contents of the configuration and the control process shown in the present embodiment can be suitably changed without leaving the scope of the present invention.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2014-049889 filed on Mar. 13, 2014 including specification, claims, drawings and abstract are incorporated herein by reference in its entirety.

What is claimed is:

1. A radio-controlled timepiece comprising:

a receiving unit which receives a transmitting radio wave including date/time information from a positioning satellite;

a date/time information obtaining unit which obtains a week number and elapsed time within a week as the date/time information from the received transmitting radio wave;

an operating unit which receives operation from a user;

a term obtaining unit which obtains a value of a 10 year digit of a present date and time according to input operation through the operating unit;

a first term setting unit which sets a first date/time specified range including 10 years corresponding to the obtained value of the 10 year digit and a term adjacent to the 10 years with a predetermined length, the first date/time specified range set to a length equal to or shorter than one lap of the week number;

a first date/time calculating unit which calculates the present date and time within the set first date/time specified range according to the week number and the elapsed time within the week;

a timekeeping unit which counts date and time; and a date/time correcting unit which corrects the date and time of the timekeeping unit based on the present date and time calculated by the first date/time calculating unit; and wherein the term obtaining unit only obtains the 10 year digit of a present date.

2. The radio-controlled timepiece according to claim 1, further comprising, a plurality of hands provided to be rotatable; and an operation control unit which controls contents displayed by the plurality of hands, wherein, at least a portion of the plurality of hands is able to move independently from other hands by control from the operation control unit; and one hand which is able to move independently from the other hands points any direction of an hour to obtain the value of the 10 year digit corresponding to the hour.

3. The radio-controlled timepiece according to claim 1, further comprising, a nonvolatile storage unit which stores the latest date and time when the present date and time was calculated by the first date/time calculating unit;

a second term setting unit which sets a second date/time specified range including a predetermined number of weeks after the latest date and time based on the latest date and time when the latest date and time is stored in the nonvolatile storage unit, the second date/time specified range set to a length equal to or shorter than one lap of the week number; and a second date/time calculating unit which calculates the present date and time within the set second date/time specified range according to the week number and the elapsed time within the week obtained by the date/time information obtaining unit, wherein, the term obtaining unit obtains the value of the 10 year digit from the operating unit when the latest date and time is not stored in the nonvolatile storage unit or the date and time within the second date/time specified range is calculated by the second date/time calculating unit; and the first date/time calculating unit recalculates the present date and time based on the first date/time specified range when it is judged whether the present date and time calculated by the second date/time calculating unit is within the first date/time specified range and the result is that the calculated present date and time is not within the first date/time specified range.

4. The radio-controlled timepiece according to claim 2, further comprising, a nonvolatile storage unit which stores the latest date and time when the present date and time was calculated by the first date/time calculating unit;

a second term setting unit which sets a second date/time specified range including a predetermined number of weeks after the latest date and time based on the latest date and time when the latest date and time is stored in the nonvolatile storage unit, the second date/time specified range set to a length equal to or shorter than one lap of the week number; and a second date/time calculating unit which calculates the present date and time within the set second date/time specified range according to the week number and the elapsed time within the week obtained by the date/time information obtaining unit, wherein, the term obtaining unit obtains the value of the 10 year digit from the operating unit when the latest date and time is not stored in the nonvolatile storage unit or the date and time within the second date/time specified range is calculated by the second date/time calculating unit; and the first date/time calculating unit recalculates the present date and time based on the first date/time specified range when it is judged whether the present date and time calculated by the second date/time calculating unit is within the first date/time specified range and the result is that the calculated present date and time is not within the first date/time specified range.

* * * * *